US007407158B2

(12) United States Patent
Ogaya et al.

(10) Patent No.: US 7,407,158 B2
(45) Date of Patent: Aug. 5, 2008

(54) SHEET FEEDING DEVICE WITH VARIABLE FACED ROLLER AND INTEGRATED SHEET GUIDES

(75) Inventors: Shunpei Ogaya, Nagano (JP); Kenichi Hirabayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 386 days.

(21) Appl. No.: 11/129,664

(22) Filed: May 16, 2005

(65) Prior Publication Data

US 2005/0253325 A1 Nov. 17, 2005

(30) Foreign Application Priority Data

May 14, 2004 (JP) ..... 2004-144861

(51) Int. Cl.
*B65H 3/52* (2006.01)

(52) U.S. Cl. ..... 271/124; 271/119; 271/121

(58) Field of Classification Search ..... 271/119, 271/121, 124
See application file for complete search history.

(56) References Cited

U.S. PATENT DOCUMENTS 5,058,877 A * 10/1991 Fujiwara et al. ..... 271/124
5,201,508 A * 4/1993 Kuo ..... 271/10.03
5,316,285 A * 5/1994 Olson et al. ..... 271/122
5,485,991 A * 1/1996 Hirano et al. ..... 271/121
5,564,688 A * 10/1996 Samii ..... 271/109
5,570,876 A * 11/1996 Samii ..... 271/119
5,695,184 A * 12/1997 Miller et al. ..... 271/121
5,884,908 A * 3/1999 Kato ..... 271/119
5,997,198 A * 12/1999 Murayama et al. ..... 400/624
6,059,281 A * 5/2000 Nakamura et al. ..... 271/119
6,086,062 A * 7/2000 Nakamura et al. ..... 271/121
6,283,468 B1 * 9/2001 Sugiura ..... 271/119
6,554,270 B2 * 4/2003 Yamamoto ..... 271/117
7,114,716 B2 * 10/2006 Otsuka et al. ..... 271/121
2002/0060396 A1 * 5/2002 Tanaka ..... 271/121
2004/0032077 A1 * 2/2004 Oh et al. ..... 271/121
2004/0051232 A1 3/2004 Masui et al.
2004/0251588 A1 12/2004 Panini et al.
2005/0035531 A1 * 2/2005 Sasaki et al. ..... 271/126
2006/0255526 A1 * 11/2006 Ginzton ..... 271/121

(Continued)

FOREIGN PATENT DOCUMENTS

JP 62-153033 7/1987

(Continued)

*Primary Examiner*—Patrick Mackey
*Assistant Examiner*—Gerald W McClain
(74) *Attorney, Agent, or Firm*—Nixon & Vanderhye P.C.

(57) ABSTRACT

A sheet feeding roller has an outer circumferential face which includes a generally flat portion and a curved portion. A first pivotable member is movable between a first position and a second position in accordance with the rotation of the sheet feeding roller. The first pivotable member has a first contact face and an extended member extended from a free end portion of the first pivotable member toward a downstream side of a sheet feeding direction. The first pivotable member is moved to the second position when a sheet medium is placed between the sheet feeding roller and the first pivotable member. The first pivotable member is returned to the first position when a trailing end of the sheet medium faces the flat portion of the sheet feeding roller while the extended member of the first pivotable member comes in contact with the sheet medium.

17 Claims, 15 Drawing Sheets

U.S. PATENT DOCUMENTS

2007/0001376 A1 * 1/2007 Lim et al. ..... 271/121

FOREIGN PATENT DOCUMENTS

JP 7-112831 5/1995
JP 8-277044 10/1996
JP 9-110206 4/1997
JP 9-267933 10/1997
JP 11-199081 7/1999
JP 2002-68503 3/2002
JP 2003026347 A * 1/2003
JP 2004-1999 1/2004

* cited by examiner

SHEET FEEDING DEVICE WITH VARIABLE FACED ROLLER AND INTEGRATED SHEET GUIDES

BACKGROUND OF THE INVENTION

The present invention relates to a sheet feeding device used in a data reading apparatus, a printing apparatus or the like to feed plural sheets of paper one by one to a processing section.

A roller type sheet feeding device used in a printer, a facsimile machine, a copying machine or the like has been generally known as a sheet feeding device.

In most cases, the roller type sheet feeding device of this kind has a cylindrical sheet feeding roller disposed at the downstream side in a sheet feeding direction, so that a sheet of paper is fed as the sheet feeding roller pulls in the sheet of paper from the vicinity of the leading end thereof.

This is because sheet feeding operations become more stable regardless of the paper rigidity by feeding sheets of paper while holding the vicinity of their leading ends. In addition, for a sheet feeding device of a type in which a separating pad is disposed downstream of a sheet feeding roller to separate sheets of paper one by one by friction produced when the leading end of a sheet of paper slides on the separating pad, it is advantageous to dispose the separating pad and the sheet feeding roller in close relation to each other in increasing the performance capability of separating plural sheets.

However, when the sheet feeding roller is disposed at the downstream side of the sheet feeding device in the sheet feeding direction, in a case where the leading ends of sheets of paper are not aligned neatly, there may be a sheet of paper whose leading end does not reach the position at which the leading end is supposed to come into contact with the sheet feeding roller. In such a case, the sheet feeding roller fails to pull in the leading end of the sheet of paper, and the sheet feeding device may become unable to feed the sheet of paper.

Normally, a counter measure to align the leading ends of sheets of paper is taken in a typical sheet feeding device, and the counter measure is broadly divided into two methods as follows.

One is a method often adapted in a laser printer, a copying machine and the like, and it is a method for positioning sheets of paper precisely on the left, right, top, and bottom by placing the sheets of paper horizontally within a sheet feeding cassette (cf., Japanese Patent Publication No. 8-277044A, for example).

The other is a method often adapted in an ink jet printer and the like, and it is a method for letting the leading ends of sheets of paper fall down to the pad portion at the lower end by gravity by setting the sheets of paper in a downward orientation (placing the sheets of paper vertically) (cf., Japanese Patent Publication No. 62-153033A, for example).

A sheet feeding cassette is necessary, however, with the method for positioning sheets of paper on the left, right, top, and bottom precisely by placing the sheets of paper horizontally, and this method makes it difficult to reduce the sheet feeding device in size.

The sheet feeding device can be reduced in size with the method for letting the leading ends of sheets of paper fall down to the pad at the lower end by gravity by setting the sheets of paper in a downward orientation. The installation posture is limited, however, because sheets of paper cannot be fed unless they are set in the vertical direction.

SUMMARY OF THE INVENTION

It is therefore an object of the invention to provide a sheet feeding device having a simple and compact structure with its installment posture being least limited and capable of feeding plural sheets of paper in a reliable manner even when the paper leading ends are aligned somewhat irregularly.

In order to achieve the above object, according to the invention, there is provided a sheet feeding device, comprising:

a sheet feeding roller having an outer circumferential face which includes a generally flat portion and a curved portion;

a first pivotable member, movable between a first position and a second position in accordance with the rotation of the sheet feeding roller, the first pivotable member comprising a first contact face and an extended member extended from a free end portion of the first pivotable member toward a downstream side of a sheet feeding direction, wherein:

the first pivotable member is moved to the second position when a sheet medium is placed between the sheet feeding roller and the first pivotable member; and the first pivotable member is returned to the first position when a trailing end of the sheet medium faces the flat portion of the sheet feeding roller while the extended member of the first pivotable member comes in contact with the sheet medium.

With this configuration, under this feeding standby condition, since the first contact face and the curved portion of the sheet feeding roller extend perpendicularly to each other, the first pivotable member is thus able to align leading ends of inserted sheet media, and there will be no event such that one of the sheet media enters into a downstream sheet transportation path accidentally.

When the first pivotable member has moved in association with rotations of the sheet feeding roller to the second position at which the first contact face of the first pivotable member pushes the curved portion of the sheet feeding roller by pressing via the sheet medium, the first pivotable member is brought into a state where it elastically pinches the sheet medium with the curved portion. The sheet medium is thus fed into the downstream sheet transportation path smoothly in association with rotation of the curved portion against which the sheet medium is pressed by the first contact face of the first pivotable member.

In a case where the extended portion is provided on the free end of the first pivotable portion as described above, when the trailing end of the fed sheet medium passes by the first pivotable member, the trailing end of the sheet medium engages the extended portion, which allows the first pivotable member to return to the first position by turning gradually in association with movements of the sheet medium.

This configuration prevents an event such that the first pivotable member returns to the first position so abruptly immediately after the trailing end of the fed sheet medium passes by the first pivotable member that it pushes the standby sheet media backward.

Preferably, the sheet feeding device further comprises a second pivotable member, movable between a third position and a fourth position in accordance with the rotation of the sheet feeding roller. The second pivotable member comprises a second contact face. The second pivotable member is placed in the third position and the first pivotable member is placed in the first position when no sheet medium is placed between the sheet feeding roller and the first pivotable member, so that a gap is formed between the flat portion of the sheet feeding roller and the second contact face while the flat portion of the sheet feeding roller and the first contact face are extended substantially perpendicularly to each other. The second pivotable member is moved to the fourth position and the first pivotable member is moved to the second position when the sheet medium is placed between the sheet feeding roller and the first pivotable member while the first contact face and the second contact face press the sheet medium against the curved portion of the sheet feeding roller.

With the above configuration, since there is a gap between the second contact face of the second pivotable member and the curved portion of the sheet feeding roller, it is possible to easily insert sheet media between the sheet feeding roller and the second pivotable member.

After the insertion of the sheet medium, the sheet feeding roller is rotated, which causes the second contact face of the second pivotable member to move to the fourth position at which the second contact face pushes the curved portion of the sheet feeding roller by pressing via the sheet medium.

The sheet feeding roller present at the standby position at which the flat portion opposes the second pivotable member is thus rotated by a certain amount, which causes the second contact face of the second pivotable member to move to the fourth position. The second pivotable member thereby pushes the sheet media by pressing toward the curved portion of the sheet feeding roller.

Each sheet medium thus first comes in contact with the leading end (a portion at which the circumferential face of the rotating sheet feeding roller switches to the curved portion from the flat portion) of the curved portion on the circumferential face of the sheet feeding roller.

In other words, it is possible to set the position at which the sheet feeding roller starts having contact with a sheet medium (a position at which the feeding roller starts to pull in the sheet medium) to a position closer to the trailing end of the sheet medium than the position at which the sheet feeding roller comes into contact with the sheet medium.

This configuration enables the sheet feeding device to pull in and feed a sheet medium in a reliable manner by the sheet feeding roller even when the sheet is not aligned neatly. In short, even when the leading ends are aligned somewhat irregularly, it is still possible to feed sheets in a stable manner.

Preferably, the first contact face and the extended member are extended substantially perpendicular to each other.

Preferably, the extended member has a curved contact face. The extended member is shaped and positioned such that the first pivotable member is gradually returned to the first position when a trailing end of the sheet medium is downstream of the second pivotable member.

In this case, because the trailing end of the sheet medium is brought into contact with the extended portion smoothly, the first pivotable member is able to return to the initial position by turning smoothly in association with movements of the sheet medium.

Preferably, a pressing force of the second pivotable member is less than a pressing force of the first pivotable member.

According to the invention, there is also provided a sheet feeding device, comprising:

an inlet section, adapted to receive at least one sheet medium;

a sheet feeding roller, having an outer circumferential face which includes a generally flat portion and a curved portion;

a first pivotable member, comprising an extended member extended from a free end portion thereof toward a downstream side in a sheet feeding direction;

a second pivotable member disposed upstream of the inlet section in the sheet feeding direction relative to the first pivotable member, so as to oppose the outer circumferential face of the sheet feeding roller through the inlet section, so that the sheet medium is elastically pressed against the outer circumferential face of the sheet feeding roller; and a control mechanism operable to pivot the second pivotable member so as to be away from the sheet feeding roller when the flat portion of the sheet feeding roller opposes the second pivotable member through the inlet section.

Preferably, the sheet feeding device further comprises a frictional stopper disposed upstream of the inlet section in the sheet feeding device and comprising a face having a higher frictional coefficient than any other portion in the inlet section.

With this configuration, in the standby state where the flat portion of the sheet feeding roller opposes the second pivotable member through the inlet section, the second pivotable member is forcedly displaced to a position apart from the sheet feeding roller by the control mechanism. In a sheet feeding state where the curved portion of the sheet feeding roller opposes the second pivotable member as the sheet feeding roller is rotated, the second pivotable member keeps pushing the at least one sheet medium elastically toward the circumferential face of the sheet feeding roller.

The sheet feeding roller in a standby state where the flat portion opposes the second pivotable member is rotated by a certain amount, and the second pivotable member is released by the control mechanism under which the second pivotable member is forcedly displaced to a position apart from the sheet feeding roller. The second pivotable member thereby elastically pushes the at least one sheet medium accommodated in the inlet section toward the circumferential face of the sheet feeding roller.

As a result, each sheet medium first comes into contact with the leading end (a portion at which the circumferential face of the rotating sheet feeding roller switches to the curved portion from the flat portion) of the curved portion on the circumferential face of the sheet feeding roller.

In other words, it is possible to set the position at which the sheet feeding roller first starts having contact with a sheet medium (a position at which the sheet feeding roller starts to pull in the sheet medium) to a position closer to the trailing end of the sheet medium than the position at which the sheet feeding roller comes into contact with the sheet medium.

This configuration enables the sheet feeding device to pull in and feed a sheet medium in a reliable manner by the sheet feeding roller even when it is not aligned neatly. In short, even when the leading ends are aligned somewhat irregularly, it is still possible to feed the sheet medium in a stable manner.

Further, in the standby state where the flat portion opposes the second pivotable member, the second pivotable member is forcedly displaced to a position apart from the sheet feeding roller by the control mechanism, and the flat portion is receded inward from the curved portion. This prevents the sheet feeding roller from protruding into the inlet section. It is thus possible to secure a sufficiently large sheet insertion space between the sheet feeding roller and the second pivotable member, which makes it easy to set the at least one sheet medium in the inlet section.

In addition, when plural sheet media are fed successively by rotating the sheet feeding roller, the first pivotable member is able to separate and supply individuals sheets while automatically adjusting an angle of contact by finding a balance between the rigidity of the sheet media and an elastic pushing force.

In a case where the extended portion is provided on the free end of the first pivotable portion, when the trailing end of the fed sheet medium passes by the first pivotable member, the trailing end of the sheet medium is brought in contact with the extended portion, which allows the first pivotable member to return to the initial position (standby position) by turning gradually in association with the movement of the sheet medium.

This configuration prevents an event such that the first pivotable member returns to the initial position so abruptly due to an elastic pushing force immediately after the trailing end of the fed sheet medium passes by the first pivotable member that it pushes the standby sheet media in the inlet section backward.

In a case where the frictional stopper is provided, even when the first pivotable member returns to the initial position so abruptly due to an elastic pushing force immediately after the trailing end of the fed sheet medium passes by the first pivotable member that it pushes back the standby sheet media in the inlet section, backward movements of the sheet media are inhibited by the frictional stopper. It is thus possible to prevent the at least one sheet medium from being pushed back.

Preferably, the extended member has a curved contact face.

In this case, because the trailing end of the sheet medium is brought into contact with the extended portion smoothly, the first pivotable member is able to return to the initial position by turning smoothly in association with movements of the sheet medium.

Preferably, the first pivotable member is adapted to elastically come in contact with the curved portion of the sheet feeding roller.

In this case, the sheet medium picked up by the first pivotable member is pinched between the curved portion of the sheet feeding roller and the first pivotable member and is reliably fed to the downstream path.

Preferably, the frictional stopper may be a sheet member provided on a bottom wall of the inlet section or saw-shaped projections formed on a bottom wall of the inlet section. In this case, the frictional stopper can be easily provided at low cost.

Preferably, a pressing force of the second pivotable member is less than a pressing force of the first pivotable member.

According to the invention, there is also provided a sheet feeding device comprising:

a sheet feeding roller;

a first pressing member disposed facing the sheet feeding roller, the first pressing member being urged in the pressing direction toward the sheet feeding roller; and a second pressing member disposed facing the sheet feeding roller upstream from the first pressing member, the first pressing member being urged in a pressing direction toward the sheet feeding roller, wherein a sheet receiving area is defined between the first pressing member, the sheet feeding roller and the second pressing member; and wherein when the sheet feeding roller feeds a sheet from the sheet receiving area in a downstream direction, the sheet is pressed against the sheet feeding roller and the first and second pressing members are pushed by the sheet in a direction opposite from the pressing direction, and wherein the first pressing member is structured such that when a trailing end of the sheet is downstream from the second pressing member, the first pressing member is gradually returned in the pressing direction.

Preferably, prior to the sheet feeding roller feeding a sheet, the first pressing member and the second pressing member are disposed substantially perpendicular to each other such that when the first pressing member returns in the pressing direction, the first pressing member serves to align sheets in the sheet receiving area.

Preferably, the first pressing member comprises an extended member extended therefrom on a downstream side thereof, the extended member being shaped and positioned to effect the gradual return of the second pressing member in the pressing direction.

Preferably, a pressing force of the second pressing member is less than a pressing force of the first pressing member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below in detail with reference to the accompanying drawings.

Figure 1:
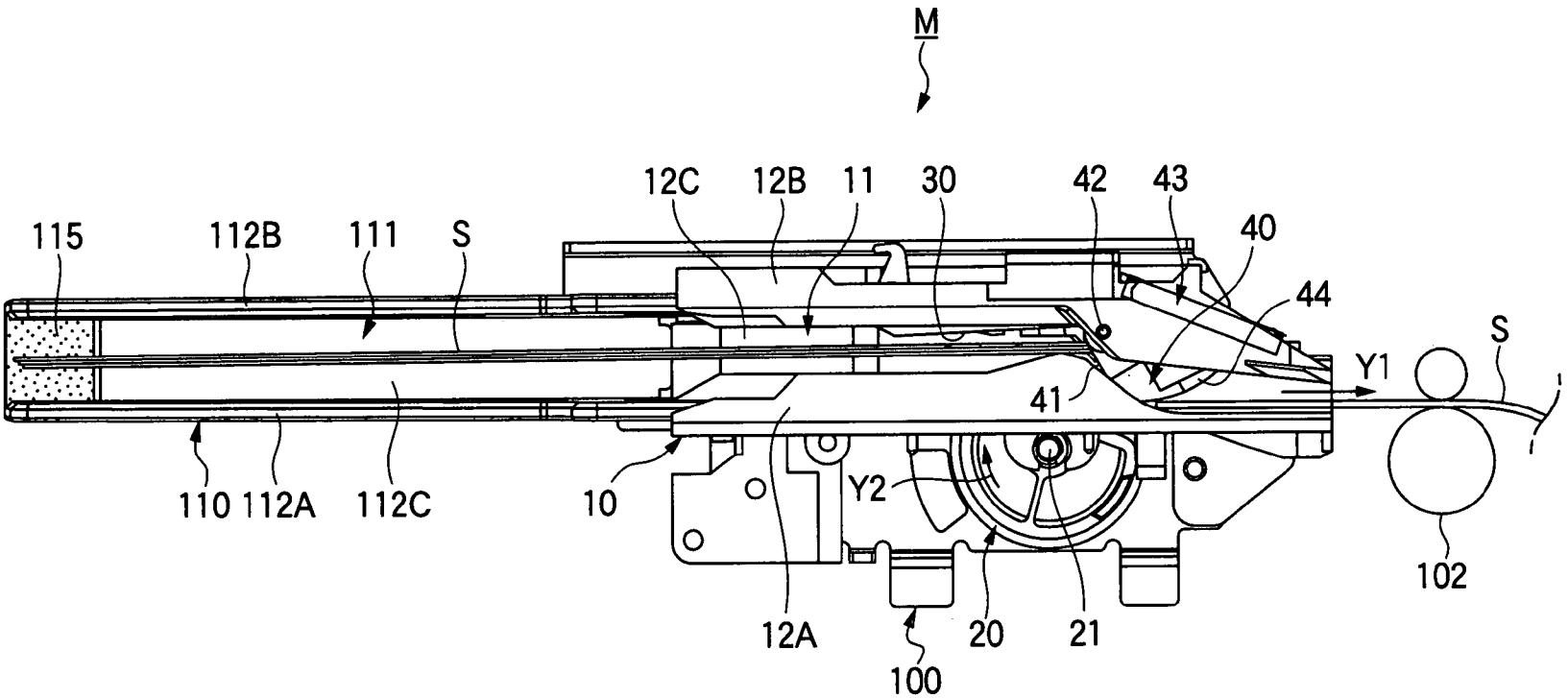
FIG. 1 is a top plan view of a sheet feeding device according to one embodiment of the invention.

As is shown in FIG. 1, a sheet feeding device M according to one embodiment of the invention is configured in such a manner that checks (sheets of paper) S are set in a sheet holder 10 in a standing posture with their leading ends (the right ends in the drawing) being oriented in the horizontal direction (in a direction indicated by an arrow Y1), and respective checks S are fed in the same posture in the horizontal direction (in the direction indicated by the arrow Y1). The sheet holder 10 attached to a frame 100 comprises a pair of side walls 12A and 12B defining a sheet inserting section 11 in which a pile of plural checks S can be manually inserted, and a bottom wall 12C on which the lower ends of checks S are mounted (see FIG. 2).

Figure 2:
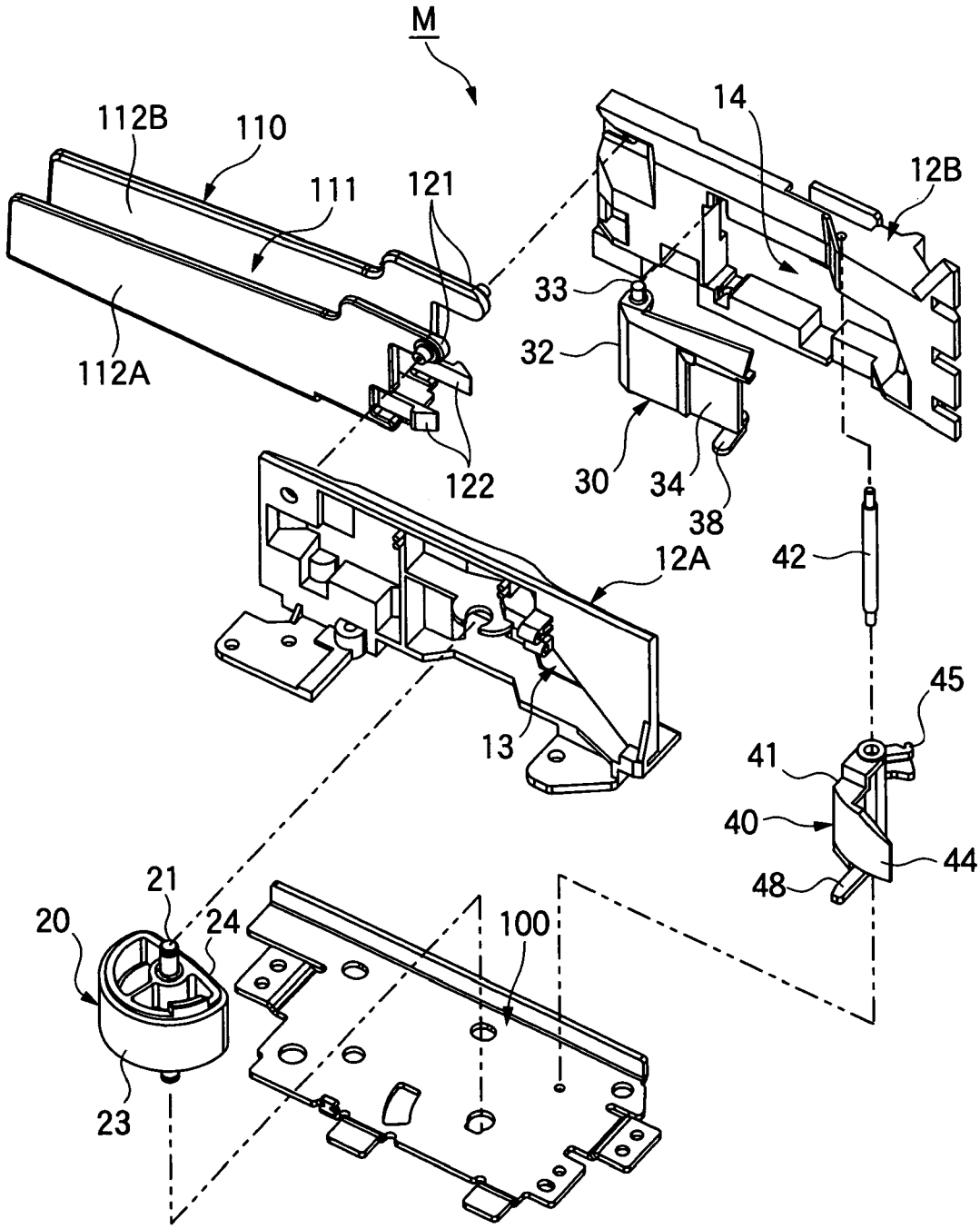
FIG. 2 is a perspective view of a disassembled state of an important part of the feeding device.

Further, a sub sheet holder 110 is detachably linked to the end portion of the sheet holder 10 of this embodiment. The sub sheet holder 110 comprises a pair of side walls 112A and 112B defining a sheet inserting section 111 that continues into the sheet holder 10, and a bottom wall 112C on which the lower ends of checks S are mounted. As is shown in FIG. 2, the sub sheet holder 110 engages with the end portion of the sheet holder 10 using two pairs of upper and lower linking arms 121 and 122 provided at the front end. Hence, in the sheet feeding device M of this embodiment, a sheet inserting section for accommodating plural checks S is defined by the sheet inserting section 11 and the sheet inserting section 111.

A frictional resistance member 115 for preventing backward movements (leftward in FIG. 1) of checks S is provided on the bottom wall 112C of the sub sheet holder 110 in a portion corresponding to the trailing ends of checks S. The frictional resistance member 115 can be formed, for example, by laminating a sheet of high friction material, such as a cork sheet.

As chief components to feed checks S set in the sheet holder 10 successively one by one, the sheet feeding device M is provided with a sheet feeding roller 20, a hopper 30, and a separating pad 40.

The sheet feeding roller 20 is disposed along the sheet holder 10 on the side of the side wall 12A, while the hopper 30 is disposed on the side of the other side wall 12B with the sheet inserting section 11 in between. The separating pad 40 is disposed downstream from the hopper 30 in a sheet feeding direction (the direction indicated by the arrow Y1) of checks S.

The sheet feeding roller 20 is fixed to a roller shaft 21 that is supported rotatably on the frame 100 and on the side wall 12A, and it feeds checks S into a downstream paper transportation path using its own circumferential face when driven to rotate in a direction indicated by an arrow Y2 by an unillustrated motor. The roller shaft 21 is disposed in a direction perpendicular to the sheet feeding direction (into the paper in FIG. 1) in order to rotate the sheet feeding roller 20 in the sheet feeding direction.

Figure 3:
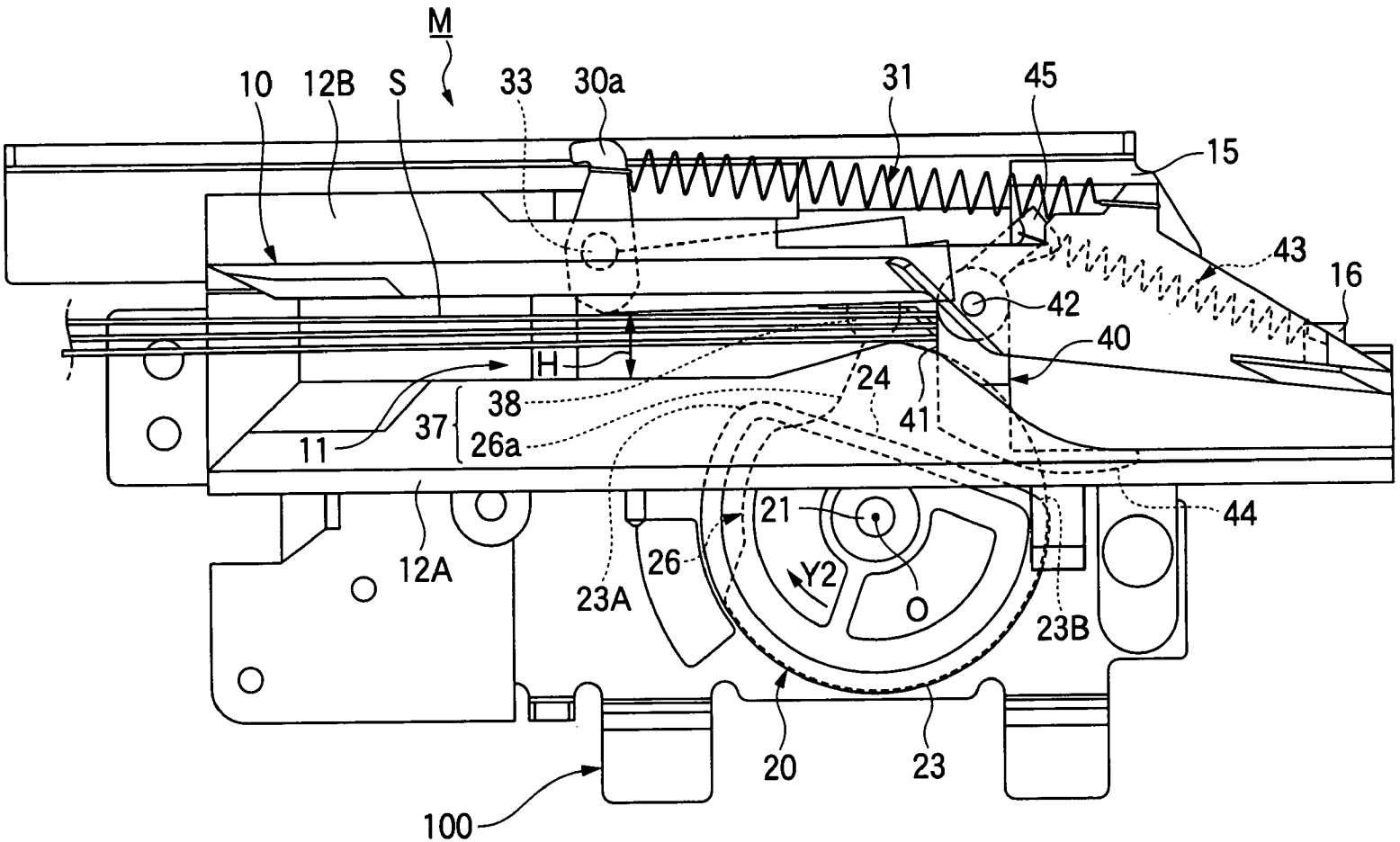
FIG. 3 is an enlarged top plan view of the part shown in FIG. 2.

As is shown in FIG. 3, a circumferential face of the sheet feeding roller 20 comprises an arc portion 23 and a chord portion 24, and is thereby shaped like a capital D. The circumferential face formed by the arc portion 23 is an arc face lying over a virtual cylindrical face (not shown) that is concentric with the rotational axis O of the sheet feeding roller 20, and the circumferential face formed by the chord portion 24 is a moderate curved face that is receded inward from the virtual cylindrical face.

Further, the circumferential face of the sheet feeding roller 20 is covered with a high friction member, such as rubber. The sheet feeding roller 20 is provided in such a manner that the rotating arc portion 23 protrudes into a space within the sheet inserting section 11 through an opening 13 (see FIG. 2) made in the side wall 12A of the sheet holder 10.

The hopper 30 is disposed almost in parallel with the side wall 12B within an opening 14 (see FIG. 2) made in the side wall 12B that opposes the circumferential face of the sheet feeding roller 20 with the sheet inserting section 11 in between. In the hopper 30, a base end 32 positioned upstream in the sheet feeding direction (the left end in FIG. 1) is supported by a spindle 33, which allows a free end to pivot between a first position and a second position (described below) about the spindle 33 parallel to the rotational axis O of the sheet feeding roller 20.

As is shown in FIG. 3, the hopper 30 is pushed toward the sheet feeding roller 20 as one end of a helical tension spring 31, which is engaged with a hook 15 of the side wall 12B at the other end, is engaged with a hook portion 30*a*, and thereby elastically pushes checks S toward the circumferential face of the sheet feeding roller 20.

Further, the sheet feeding device M of this embodiment is provided with a hopper control mechanism 37 that forces the hopper 30 to be displaced in response to the rotating position of the sheet feeding roller 20.

As is shown in FIG. 3, the hopper control mechanism 37 comprises a hopper driving cam 26*a* of a disc cam 26 attached to the roller shaft 21 of the sheet feeding roller 20, and a cam follower 38 provided to the hopper 30 so as to slide on the hopper driving cam 26*a*.

The hopper control mechanism 37 regulates the position of the hopper 30 with respect to the sheet feeding roller 20 against a pushing force of the helical tension spring 31. In a standby state (paper insertion waiting position) in which the chord portion 24 of the sheet feeding roller 20 opposes the hopper 30 almost in parallel with the sheet inserting section 11 in between, the hopper control mechanism 37 forces the hopper 30 to be displaced to the first position (see FIG. 3 and FIG. 4) at which a clearance is present between a pressing face 34 of the hopper 30 and the chord portion 24 of the sheet feeding roller 20.

Figure 5:
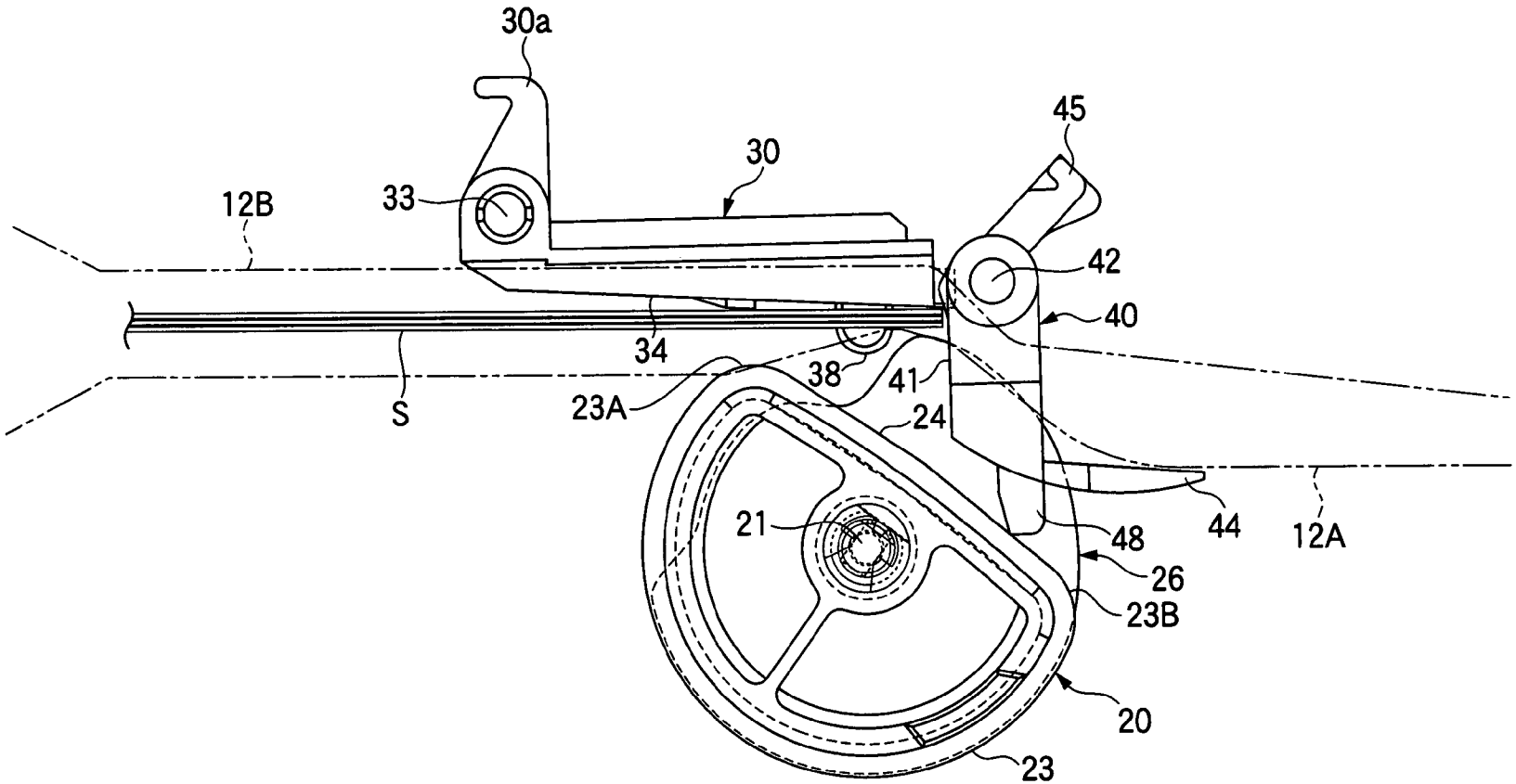
FIG. 5 is a schematic top plan view of the part shown in FIG. 2 showing a state that the hopper is moved from a first position to a second position in accordance with the movement of the sheet feeding roller.
Figure 6:
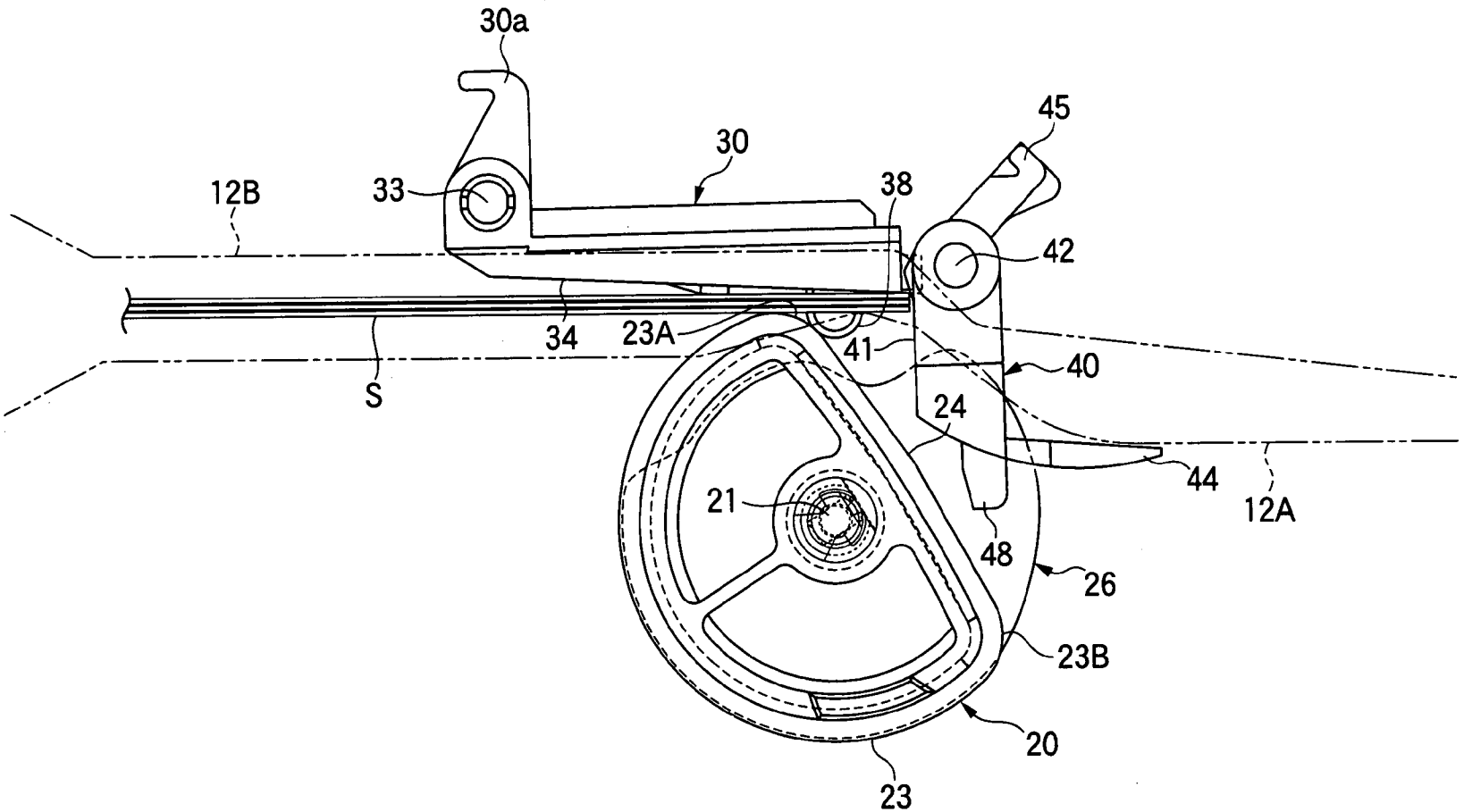
FIG. 6 is a schematic top plan view of the part shown in FIG. 2 showing a state before the hopper starts to move to the first position.
Figure 7:
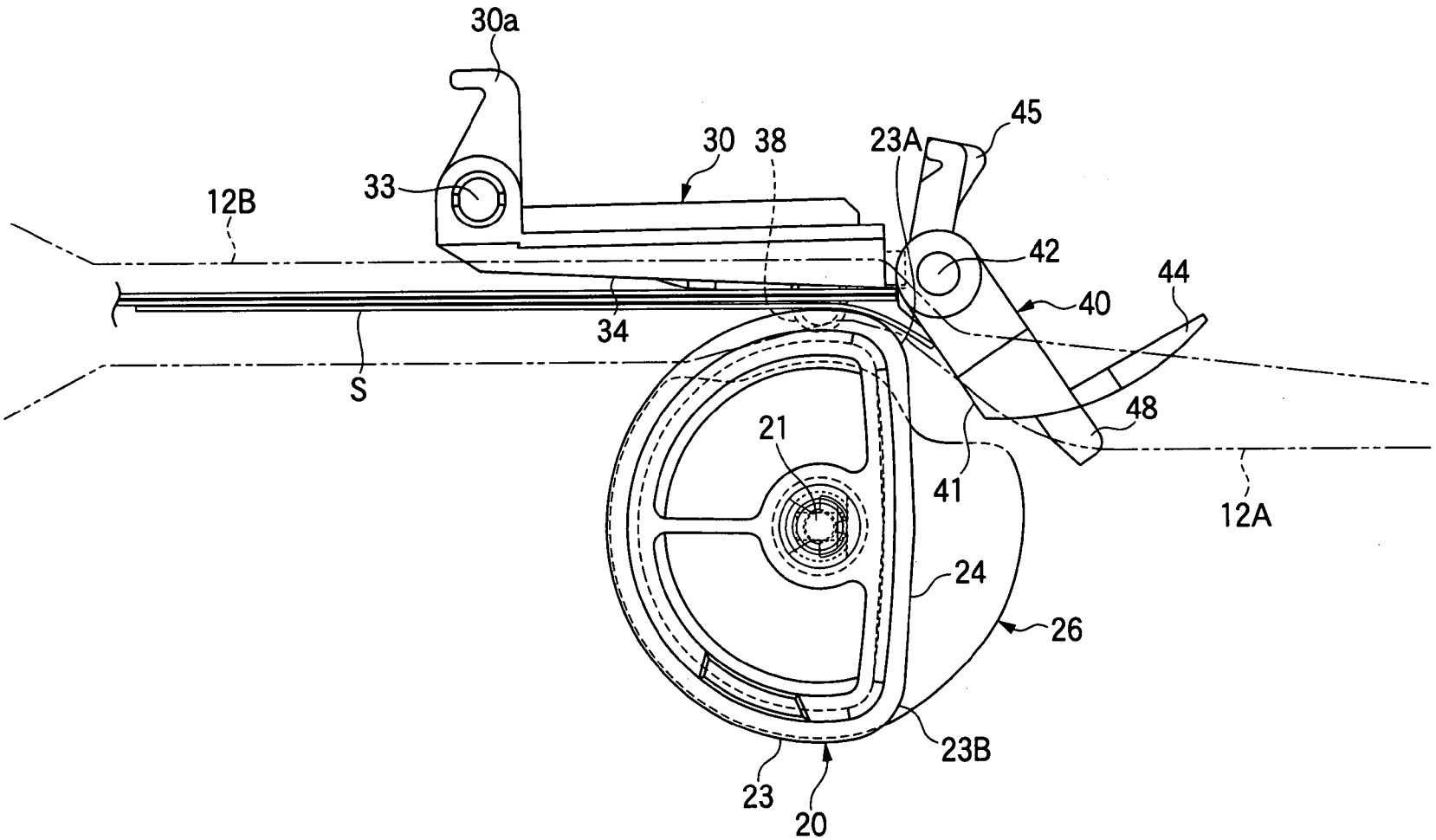
FIG. 7 is a schematic top plan view of the part shown in FIG. 2 showing a state that the hopper moves from the second position to the first position and the separation pad moves from a third position to a fourth position.

The hopper 30 is released from the restrictions under which it is forcedly displaced to a position apart from the sheet feeding roller 20 while the arc portion 23 in a specific range remains at a position at which the arc portion 23 opposes the hopper 30 since the leading end 23A (a portion at which the circumferential face of the sheet feeding roller 20 switches from the chord portion 24 to the arc portion 23) of the arc portion 23 of the sheet feeding roller 20 started to move closer to the hopper 30 in association with rotations of the sheet feeding roller 20 (see FIG. 5 through FIG. 7). Hence, in this instance, the hopper 30 moves to the second position (see FIG. 6 and FIG. 7) at which the pressing face 34 of the hopper 30 pushes toward the arc portion 23 of the sheet feeding roller 20 due to a pushing force of the helical tension spring 31.

The pressing face 34 of the hopper 30 that abuts on a check S protrudes toward the sheet feeding roller 20 in comparison with the other portions, and is provided with a high friction material, such as a cork sheet. The upper side and the base end 32 of the pressing face 34 comprise inclined planes, so that they will not cause any trouble when checks S are let fall into the sheet inserting section 11.

The separating pad 40 separates a pile of plural checks S set in the sheet inserting section 11 one by one as the leading end of each check S, which is being fed while it is sandwiched between the sheet feeding roller 20 and the hopper 30, slides on a pad face (abutting face) 41.

The separating pad 40 is supported rotatably in such a manner that its free end is allowed to pivot between a third position and a fourth position described below about a spindle 42 disposed in the vicinity of the free end of the hopper 30, and the turning tip end is elastically pushed in the trailing end direction of checks S as one end of a helical tension spring 43, which is engaged with a hook portion 16 of the side wall 12B at the other end (FIG. 3), is engaged with a hook portion 45.

Figure 4:
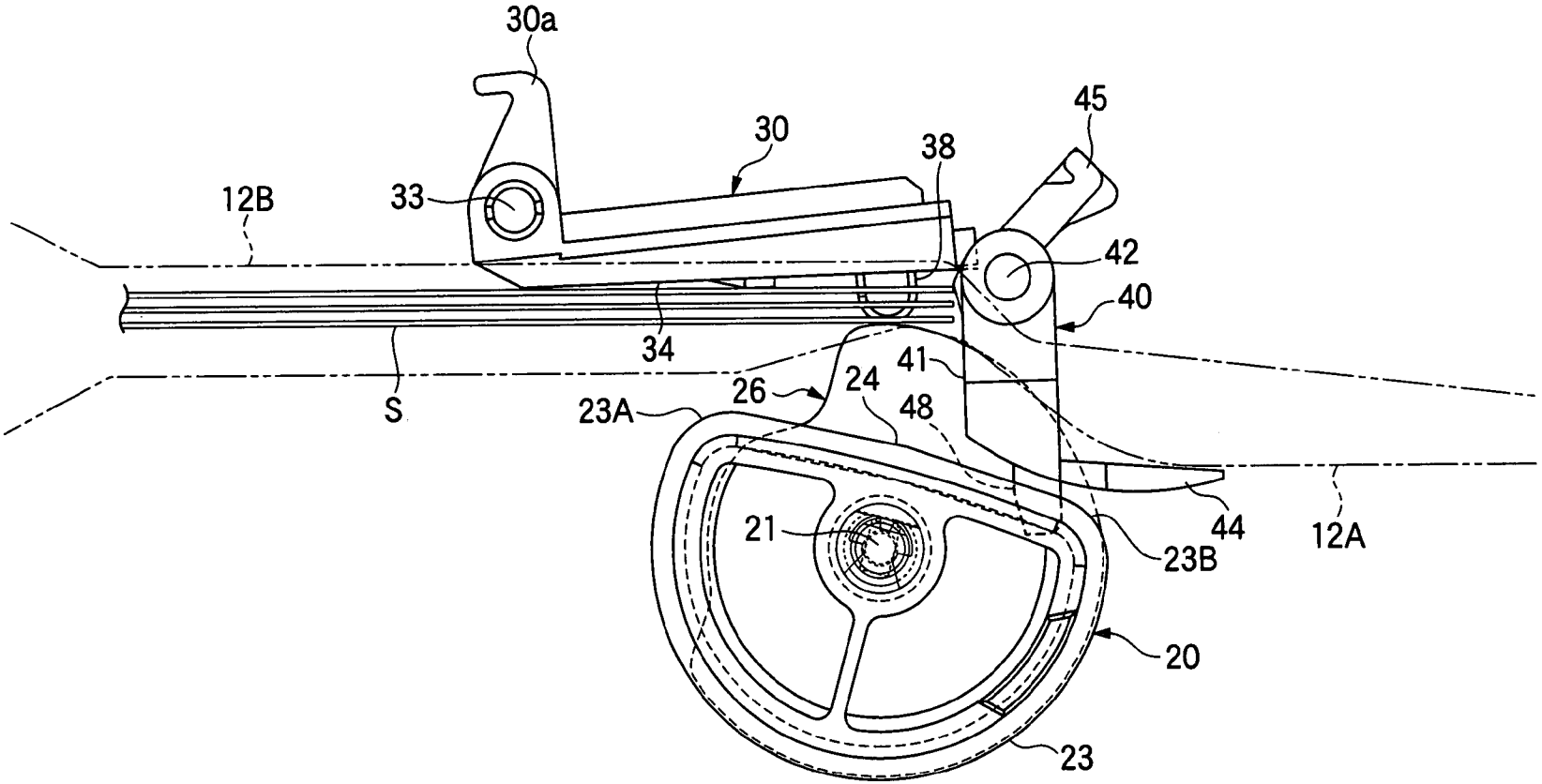
FIG. 4 is a schematic top plan view of the part shown in FIG. 2 showing a state that a hopper, a separation pad and a sheet feeding roller in the feeding device are in a standby position.

Hence, as are shown in FIG. 3 and FIG. 4, in the absence of interference (the arc portion 23 of the sheet feeding roller 20) along the way, the separating pad 40 is allowed to turn to an initial position (the third position at which the pad face 41 of the separating pad 40 intersects with the chord portion 24 of the sheet feeding roller 20 almost at right angles) at which the separating pad 40 is able to position the leading ends of checks S while keeping an angle of contact with respect to the leading ends of checks S to be approximately 90 degrees. As is shown in FIG. 7, a cam follower 48 is regulated by an unillustrated cam mechanism so that a specific tilting angle is maintained at specific timing (for example, in a stage where the separating pad 40 waits for the leading end of the check S on the top of the pile to be fed).

Further, the turning tip end of the separating pad 40 is provided with an extended portion 44 that extends downstream in the paper transport direction (rightward in FIG. 3 and FIG. 4) along a turning locus of the turning tip end.

The extended portion 44 has a moderate arc face as the circumferential face that slides on a check S being fed, and continues into the pad face 41.

In other words, the separating pad 40 comprises an L-shaped longitudinal portion having the pad face 41 and an L-shaped lateral portion including the extended portion 44.

As is shown in FIG. 1, a sheet feeding roller 102 that transports checks S is provided downstream from the sheet inserting section 11, and it transports checks S fed from the sheet feeding device M along a downstream paper transportation path.

Operations of the sheet feeding device M according to this embodiment will now be described.

In a case where plural checks S are fed by the sheet feeding device M, as are shown in FIG. 3 and FIG. 4, a pile of plural checks S are set in the sheet holder 10 in a standing posture with their leading ends being oriented in the horizontal direction (a rightward direction in the drawing).

In this stage, the hopper driving cam 26*a* abuts on the cam follower 38 of the hopper 30, which allows the hopper 30 to be held at the standby position (first position) apart from the sheet feeding roller 20 against a pushing force of the helical tension spring 31. In addition, because the chord portion 24 of the sheet feeding roller 20 opposes the hopper 30 almost in parallel, a substantial opening width H of the sheet inserting section 11 is kept at its maximum, which makes it easy to insert plural checks S.

While the cam follower 48 abuts the unillustrated cam mechanism, the separating pad 40 is held at the initial position (the third position at which the pad face 41 intersects with the chord portion 24 almost at right angles) at which the separating pad 40 is able to position the leading ends of checks S, and thereby blocks the paper transportation path downstream from the sheet inserting section 11.

Thus, in the paper insertion waiting state where the chord portion 24 of the sheet feeding roller 20 opposes the hopper 30, the separating pad 40 is able to position the leading ends of checks S when the checks S are set in the sheet inserting section 11. In other words, there will be no event such that a check S set in the sheet inserting section 11 enters into the downstream paper transportation path accidentally, and feeding two checks at a time can be prevented.

Under these states, as is shown in FIG. 5, the sheet feeding roller 20 is rotated in the direction indicated by the arrow Y2 by driving the unillustrated sheet feeding motor, which causes the leading end 23A of the arc portion 23 of the sheet feeding roller 20 to gradually move closer to the hopper 30. In this stage, the hopper 30 is released from the restrictions under which it is forcedly kept at the standby position, and the hopper 30 thereby elastically pushes checks S toward the circumferential face of the sheet feeding roller 20.

In this instance, because the sheet feeding roller 20 is in the stage as is shown in FIG. 6 where the leading end 23A of the arc portion 23 is moving closer to the hopper 30 in the sheet feeding direction of the rotational axis O of the sheet feeding roller 20, each check S first comes into contact with the leading end 23A of the arc portion 23 of the sheet feeding roller 20 at an upstream position in the sheet feeding direction of the rotational axis O. This position is present at an upstream position in the sheet feeding direction from the rotational axis O of the sheet feeding roller 20 by a dimension about half the radius of the sheet feeding roller 20. Hence, even when the leading end of a check S is displaced slightly to an upstream side from the rotational axis O, it is still possible to catch the leading end of the check S in a reliable manner by the arc portion 23 of the sheet feeding roller 20.

When the sheet feeding roller 20 rotates further from this state, the hopper 30 is pushed back toward the standby position due to rotations of the arc portion 23, and as is shown in FIG. 7, the check S on the top of the pile is fed in the sheet feeding direction (in the direction indicated by the arrow Y1) while it is sandwiched between the peripheral face of the arc portion 23 and the hopper 30.

It should be noted that the separating pad 40 is gradually pushed back against a pushing force of the helical tension spring 43 due to a function of the unillustrated cam mechanism, and is tilted by a predetermined angle of contact with respect to the leading ends of checks S.

Hence, the separating pad 40 set at the specific tilting angle waits for the check S to arrive, and in the following stage, the pad face 41 of the separating pad 40 receives the leading end of the check S at the predetermined angle of contact, and separates the check S on the top of the pile from the check S underneath while automatically adjusting an angle of contact by finding a balance between the resistance of the check S and a pushing force of the helical tension spring 43.

Figure 8:
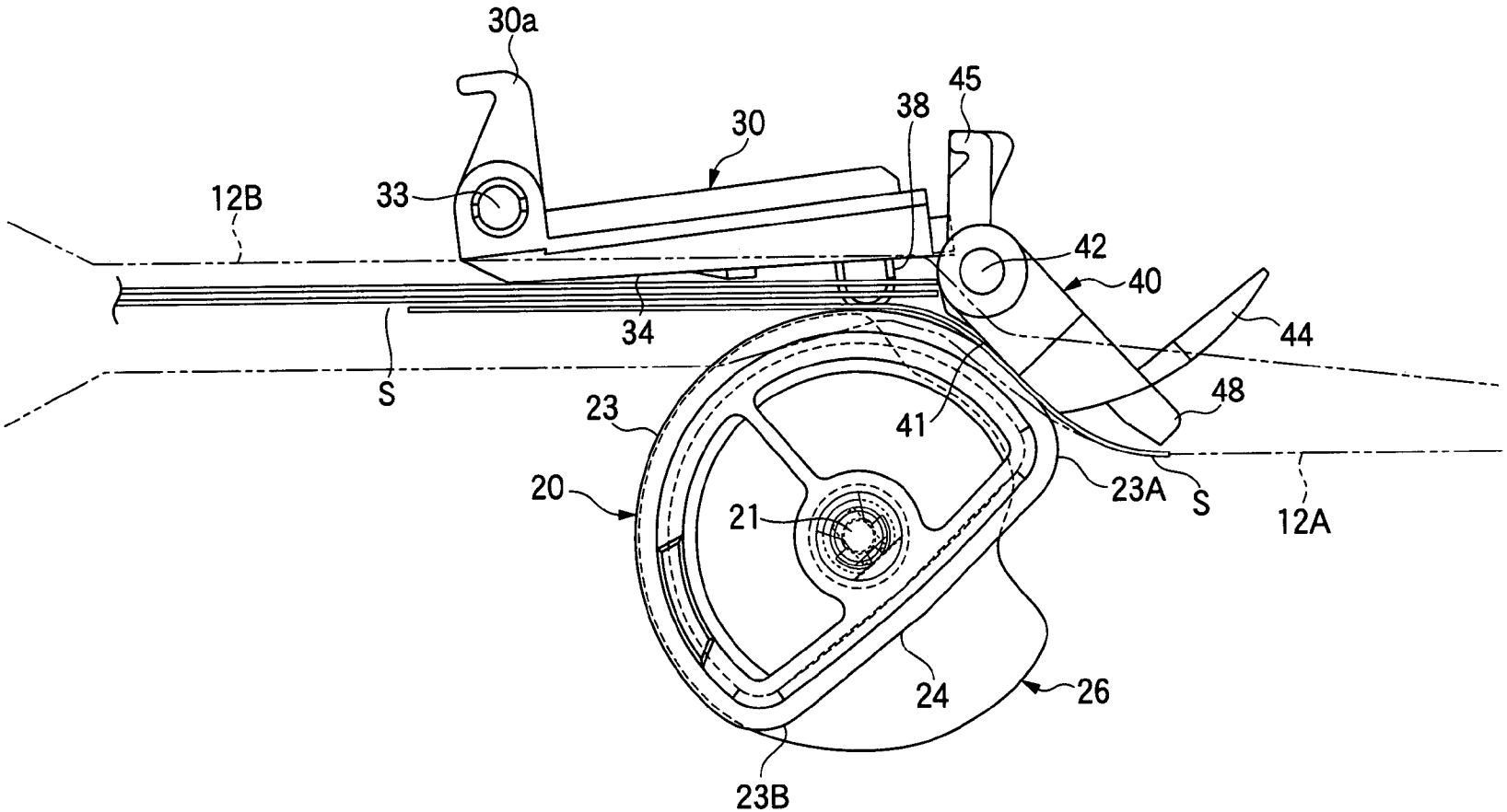
FIGS. 8 and 9 are schematic top plan views of the part shown in FIG. 2 showing a state that a print sheet is fed while being clamped by the separation pad and the sheet feeding roller.
Figure 9:
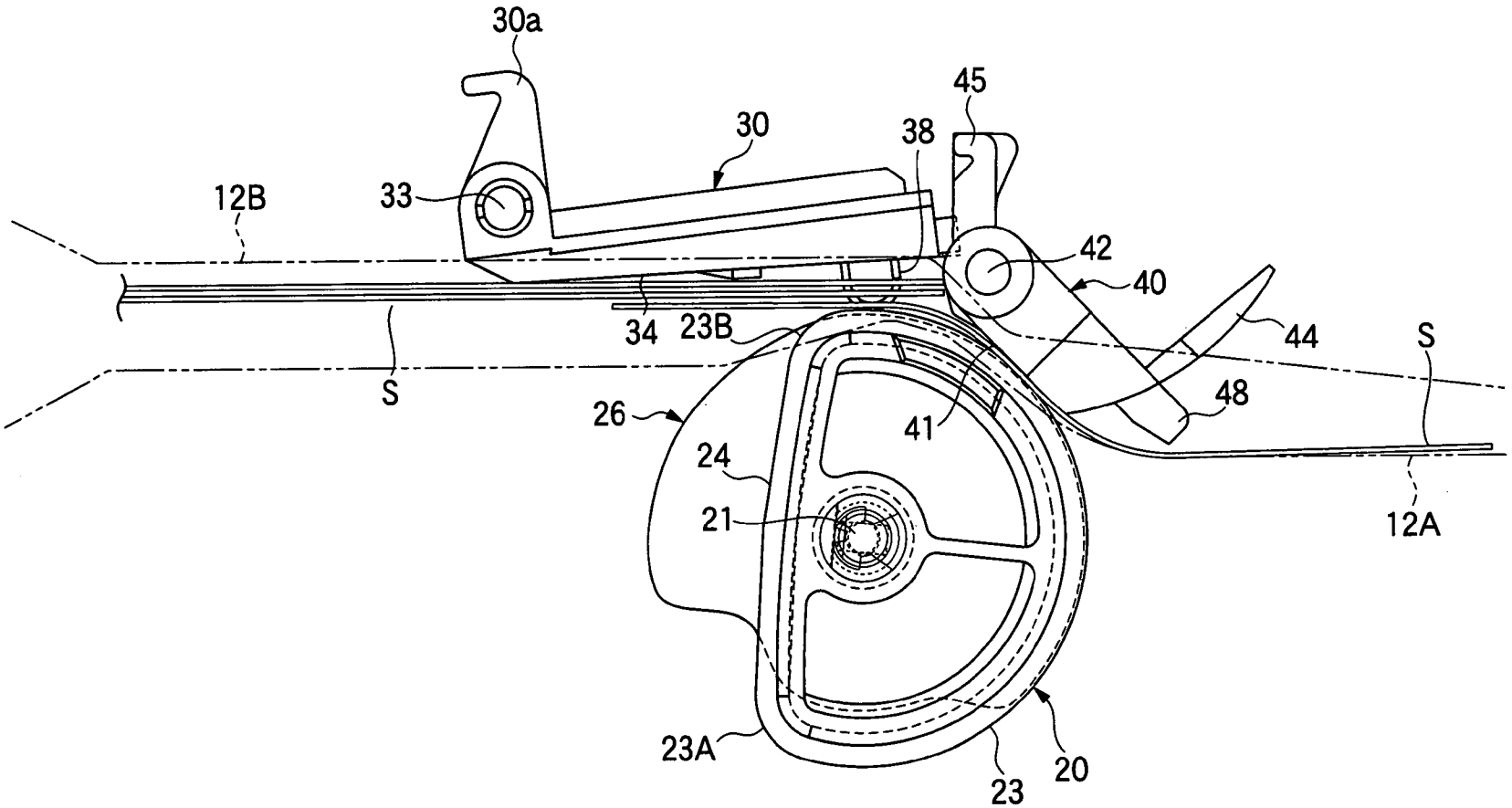
Figure 10:
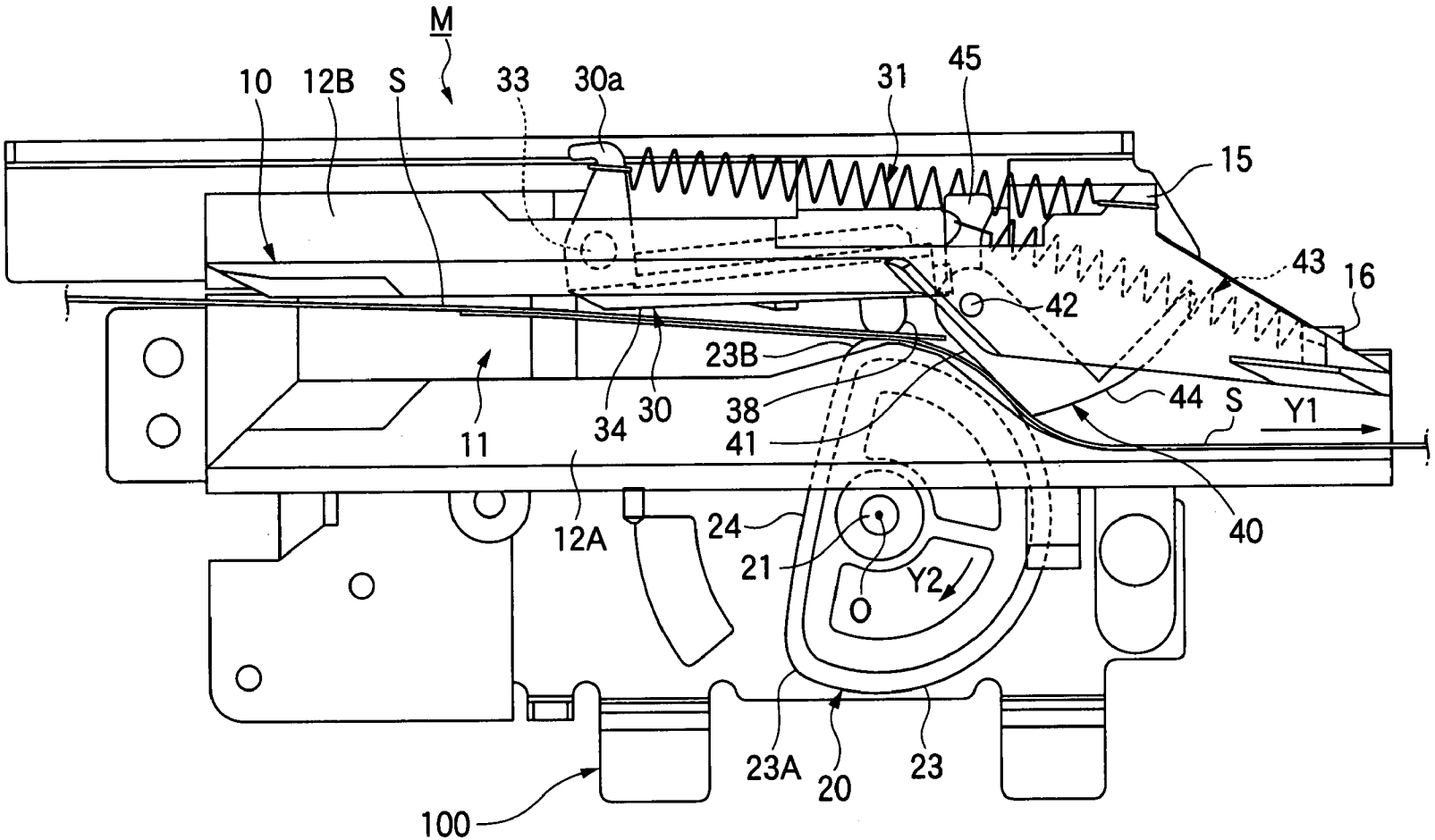
FIG. 10 is an enlarged top plan view of the part shown in FIG. 2 showing the state that the print sheet is fed while being clamped by the separation pad and the sheet feeding roller.

Further, as are shown in FIG. 8 through FIG. 10, the separating pad 40 is set such that the pad face 41 moves in association with the sheet feeding roller 20 to the fourth position at which the pad face 41 of the separating pad 40 pushes the arc portion 23 of the sheet feeding roller 20 by pressing via the check S. The separating pad 40 is thus brought into a state where it elastically pinches the check S with the arc portion 23.

As a result, a single check S fed from the sheet inserting section 11 by the arc portion 23 of the sheet feeding roller 20 is separated while its leading end slides on the pad face 41, after which it is fed smoothly to the outside of the sheet feeding device M (for example, into the downstream paper transportation path) in association with rotation of the arc portion 23 against which the check S is pressed by the pad face 41 of the separating pad 40.

In this instance, in order to prevent the check S present underneath from being fed together with the separated check S on the top of the pile, a pressing force of the hopper 30 that acts on the arc portion 23 of the sheet feeding roller 20 is set to be sufficiently smaller than a pressing force of the separating pad 40.

In the latter half of the feeding of a single check S by rotation of the arc portion 23 of the sheet feeding roller 20, as is shown in FIG. 8, the hopper 30 is pushed back to the standby position due to the function of the hopper control mechanism 37 comprising the hopper driving cam 26*a* of the disc cam 26 and the cam follower 38 provided to the hopper 30.

The checks S are thereby fed one by one in a reliable manner while being pinched elastically between the separating pad 40 and the arc portion 23. After the leading end reaches the downstream sheet feeding roller 102, each check S is fed along the downstream paper transportation path due to a driving force of the sheet feeding roller 102.

Figure 11:
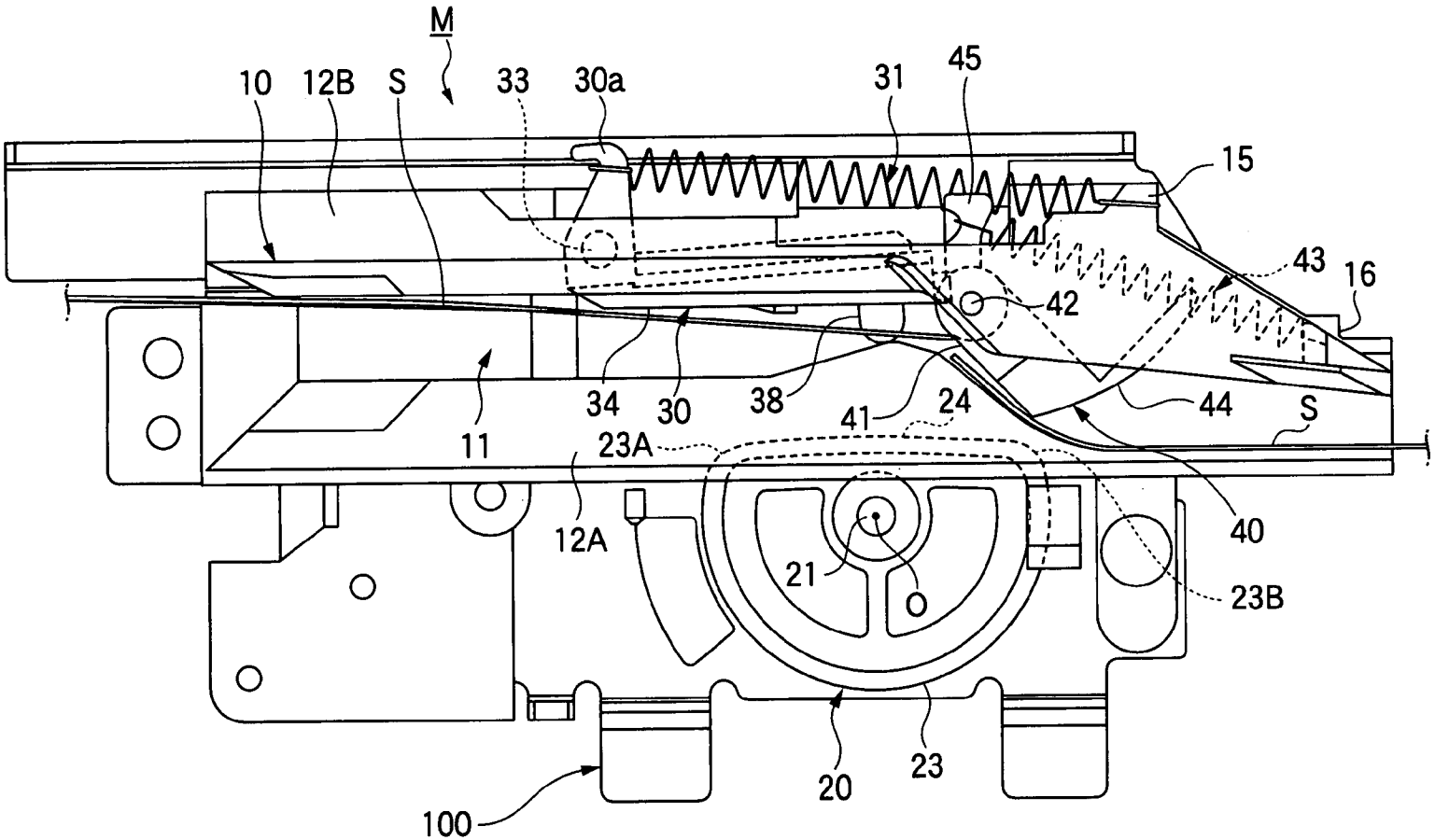
FIG. 11 is an enlarged top plan view of the part shown in FIG. 2 showing the state that the separation pad is kept at the fourth position.

Thereafter, a trailing end 23B (a portion at which the circumferential face of the sheet feeding roller 20 switches from the arc portion 23 to the chord portion 24) of the arc portion 23 that has been opposing the separating pad 40 passes by the separating pad 40, at which point the separating pad 40 tries to turn in the trailing end direction of a sheet of paper due to a pushing force of the helical tension spring 43; however, as is shown in FIG. 11, because the trailing end of the check S is sandwiched between the separating pad 40 and the side wall 12A, the separating pad 40 is not allowed to turn.

Figure 12:
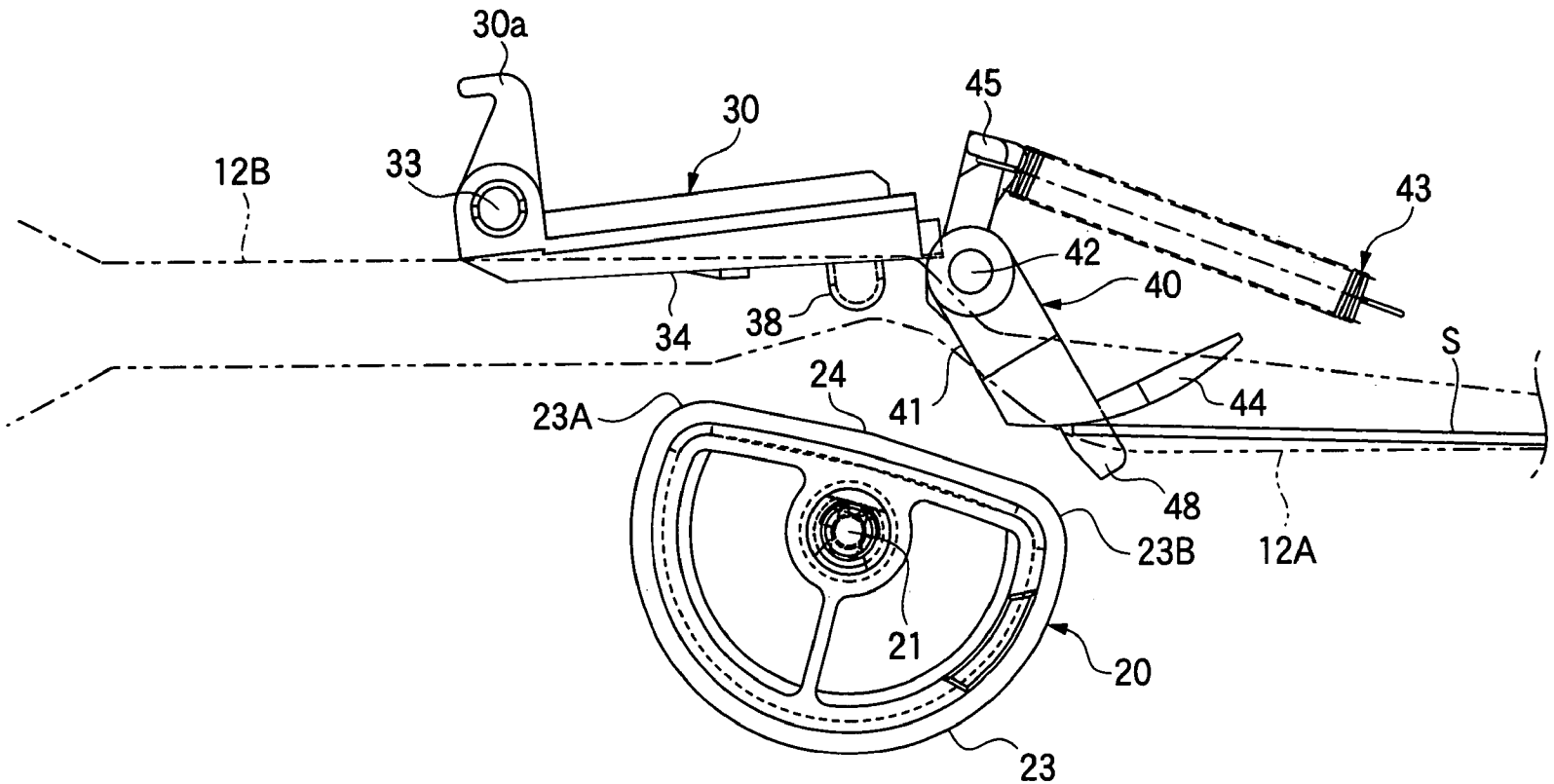
FIGS. 12 and 13 are schematic top plan views of the part shown in FIG. 2 showing a state that a trailing end portion of the printing medium is brought into contact with a part of the separation pad.
Figure 13:
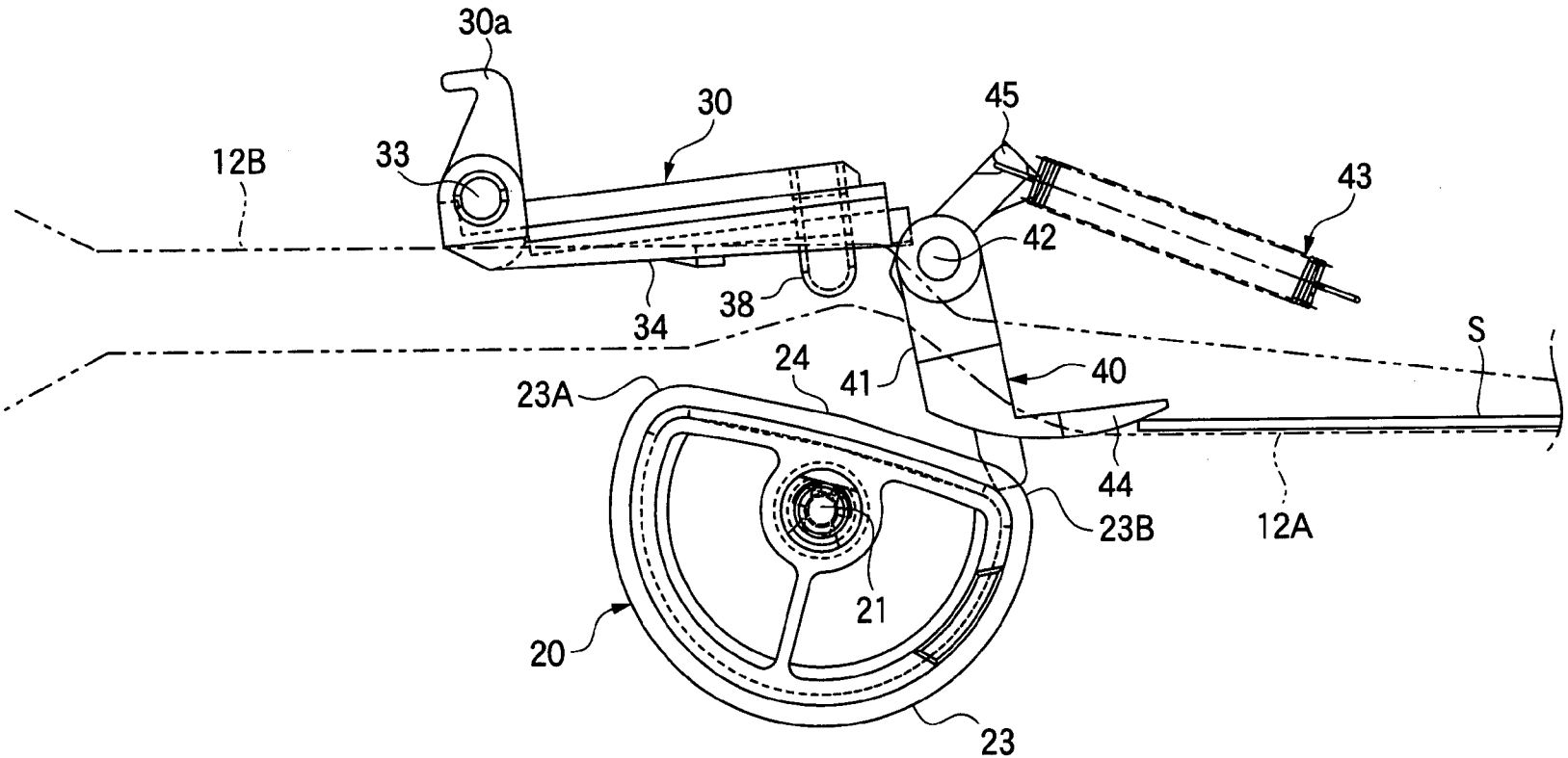

The check S is transported by the sheet feeding roller 102 in this state, and when it passes by the separating pad 40, the trailing end of the fed check S engages with the extended portion 44 provided at the turning tip end of the separating pad 40, which allows the separating pad 40 to return to the initial position (the third position) by turning gradually in association with movements of the check S as are shown in FIG. 12 and FIG. 13. The extended portion 44 has an arc face as the circumferential face that slides on the check S being fed, and because the trailing end of the check S engages with the extended portion 44 smoothly, the separating pad 40 is able to return to the initial position by turning smoothly in association with movements of the check S.

Hence, in a case where the leading end of a check S on standby in the sheet inserting section 11 protrudes as far as the position at which the leading end abuts on the frictional pad 40, such a check is pushed back by the separating pad 40. The leading ends of checks S are thus aligned neatly. In this instance, because the hopper 30 has been displaced to the position apart from the sheet feeding roller 20, checks S are allowed to move with relative ease, which enables the separating pad 40 to align the leading ends of checks S neatly without any trouble.

In other words, each time a single check S has been fed as the check S is transported and passes by the separating pad 40, a function of aligning the leading ends of checks S is performed as the separating pad 40 pivots to a position at which it is able to position the leading ends of the checks S.

In this instance, the separating pad 40 provided with the extended portion 44 returns to the initial position by turning gradually in association with movements of the check S as described above. Hence, there will be no event such that the separating pad 40 returns to the initial position so abruptly due to a pushing force of the helical tension spring 43 immediately after the trailing end of the fed check S passes by the separating pad 40 that it flips checks S on standby in the sheet inserting section 11 backward.

Because the leading ends of checks S on standby will not be flipped backward up to or beyond the specific position by the separating pad 40 returning to the initial position, the D-shaped sheet feeding roller 20 never fails to catch the leading end of a check S. The possibility of missing a check S is thereby eliminated.

Further, in the sheet feeding device M of this embodiment, the frictional resistance member 115 (see FIG. 1) for preventing backward movements of checks S is provided on the bottom wall 112C of the sub sheet holder 110 in a portion corresponding to the trailing ends of checks S.

In the sheet feeding device M of this embodiment, in order to prevent backward movements of checks S on standby, not only the extended portion 44 is provided on the separating pad 40 at the turning tip end, but also the frictional resistance member 115 is provided in the sub sheet holder 110; however, it is sufficient to provide either one of them.

Figure 14:
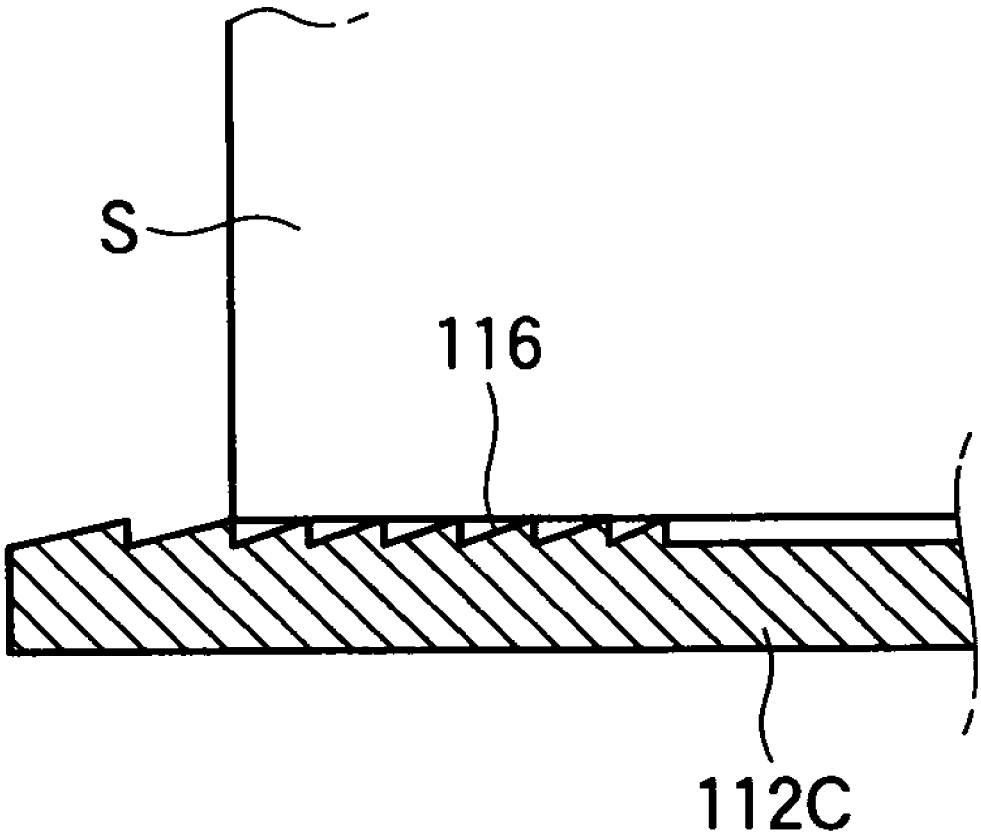
FIG. 14 is a schematic section view showing a modified example of the sheet feeding device.

It is preferable to form the frictional resistance member 115 for preventing backward movements of checks S by laminating a sheet of high friction material, such as a cork sheet, as is shown in FIG. 1, because the manufacturing can be simpler. However, as is shown in FIG. 14, saw-tooth stopper protrusions 116 may be provided on the bottom wall 112C of the sub sheet holder 110 in a portion corresponding to the trailing ends of checks S, so that the trailing ends of checks S will be hooked.

As has been described, even when the leading ends of checks S in the sheet inserting section 11 are present upstream in the sheet feeding direction, the sheet feeding device M of this embodiment is able to pull in and feed the checks S in a reliable manner by a single sheet feeding roller 20. In short, even when the leading ends are aligned somewhat irregularly, it is still possible to feed checks S in a stable manner.

In comparison with a case where more than one roller is used, the mechanism can be simpler and smaller. In addition, because it is not configured to align the leading ends of checks S by gravity, the sheet feeding device M is applicable in a case where checks S are placed in a standing posture with the leading ends of checks S being oriented horizontally. Moreover, because the sheet feeding device M permits almost any installation posture, it can be incorporated into various kinds of apparatus, such as a printer and a data reading apparatus.

Figure 15:
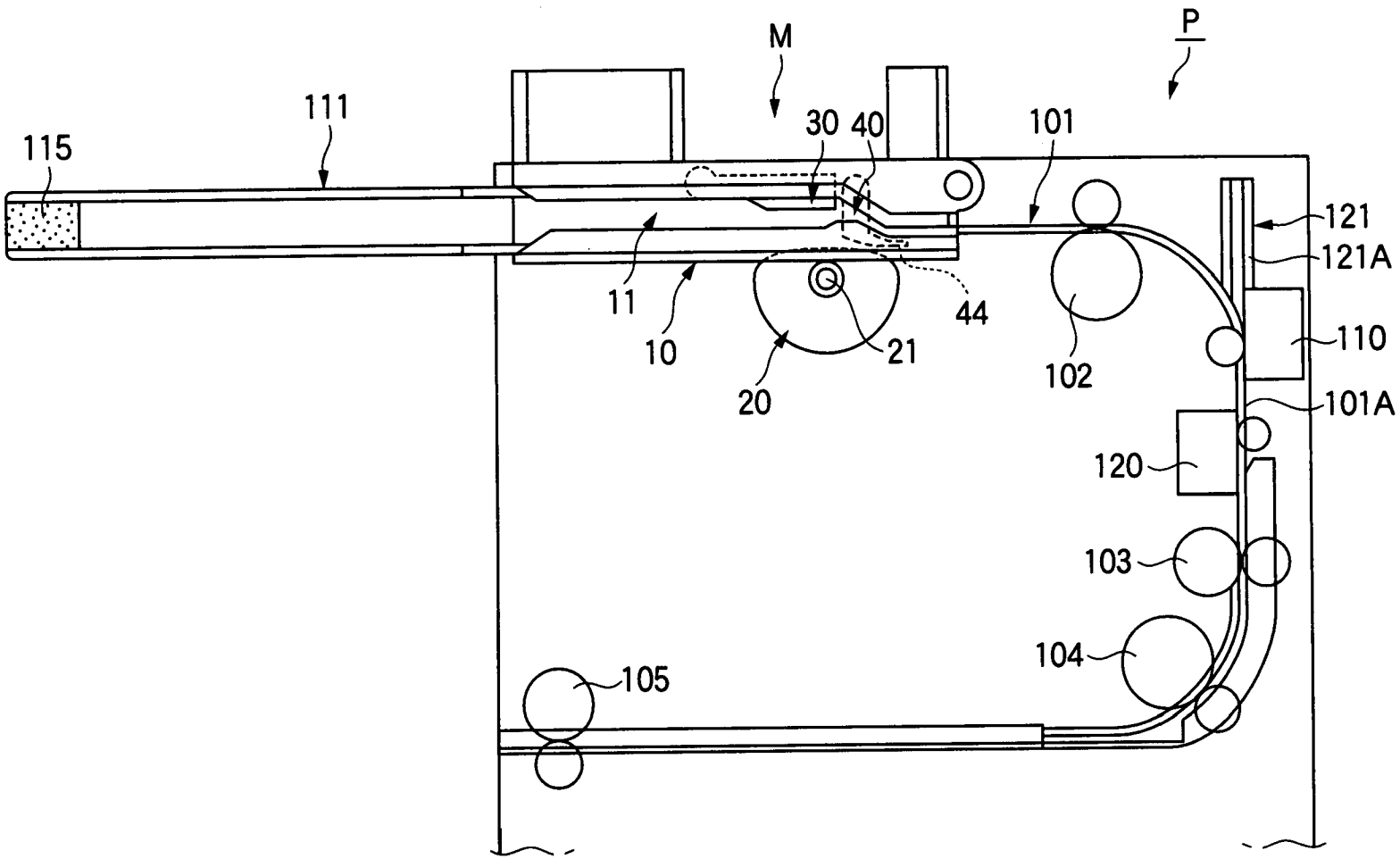
FIG. 15 is a schematic plan view of a data reading apparatus incorporating the sheet feeding device of FIG. 1.

FIG. 15 is a plan view showing the layout of a data reading apparatus P in which the sheet feeding device M of this embodiment is incorporated.

In the data reading apparatus P, the sheet feeding device M of this embodiment is disposed at the inlet of a first transportation path 101 that is laid out in the shape of a capital U, and sheet feeding rollers 102, 103, and 104 are disposed at appropriate points along the first transportation path 101 while a discharge roller 105 is disposed at the outlet. Reading processors (scanners) 110 and 120 are disposed at an intermediate linear portion 101A in the U-shaped first transportation path 101. In addition, a linear transportation path 121A that forms a linear second transportation path 121 by sharing the intermediate linear portion 101A is connected to an extension of the intermediate linear portion 101A.

In the data reading apparatus P, when a check S is fed from the sheet feeding paper M, the check S in the standing posture moves along the U-shaped transportation path 101, and data recorded in the check S is read by the reading processors 110 and 120 along the way. In a case where a high-rigid card, such as a driver's license card and an ID card, is to be read, data on the card can be read by the reading processors 110 and 120 by moving the card using the second transportation path 121.

In a case like this example where plural checks S are set in the standing posture and checks S in the standing posture are fed in the horizontal direction, positions of the leading ends of checks S are not aligned neatly in many cases. However, even when the leading ends are aligned somewhat irregularly, the sheet feeding device M of this embodiment is able to feed checks S in a reliable manner. That is, the sheet feeding device M has a simple mechanism, yet permits almost any installation posture, and is able to ensure the sheet feeding reliability.

The configurations of first oscillating member, the second oscillating member, the sheet feeding roller, the sheet inserting section, the first oscillating member control mechanism, the extended portion, the frictional resistance member, etc. in the sheet feeding device of the invention are not limited to the configurations of the embodiment above, and it goes without saying that the configurations can vary within the scope of the invention.

For example, the hopper 30 in the embodiment above was configured in such a manner that its free end is allowed to pivot about the spindle 33 parallel to the rotational axis O of the sheet feeding roller 20; however, it may be configured in such a manner that the pressing face is allowed to move forward and backward in parallel with respect to the rotational axis O of the sheet feeding roller 20.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A sheet feeding device, comprising:

an inlet section, adapted to receive at least one sheet medium;

a sheet feeding roller, having an outer circumferential face which includes a flat portion and a curved portion;

a first pivotable member, comprising an extended member extended from a free end portion thereof toward a downstream side in a sheet feeding direction;

a second pivotable member disposed upstream in the sheet feeding direction of the first pivotable member, so as to oppose the outer circumferential face of the sheet feeding roller through the inlet section, so that the sheet medium is elastically pressed against the outer circumferential face of the sheet feeding roller, the second pivotable member having a cam follower engaged with a cam interlocked with the sheet feeding roller; and a control mechanism including the cam interlocked with the sheet feeding roller operable to pivot the second pivotable member so as to be away from the sheet feeding roller when the flat portion of the sheet feeding roller opposes the second pivotable member through the inlet section.

2. The sheet feeding device as set forth in claim 1, wherein the extended member has a curved contact face.

3. The sheet feeding device as set forth in claim 1, wherein the first pivotable member is adapted to elastically contact the curved portion of the sheet feeding roller.

4. The sheet feeding device as set forth in claim 1, wherein a pressing force of the second pivotable member is less than a pressing force of the first pivotable member.

5. The sheet feeding device as set forth in claim 1, further comprising a frictional stopper disposed upstream of the inlet section in the sheet feeding device and comprising a face having a higher frictional coefficient than a portion disposed downstream of the inlet section.

6. The sheet feeding device as set forth in claim 5, wherein the frictional stopper is a sheet member provided on a bottom wall of the inlet section.

7. The sheet feeding device as set forth in claim 5, wherein the frictional stopper comprises saw-shaped projections formed on a bottom wall of the inlet section.

8. A sheet feeding device, comprising:

a sheet feeding roller having an outer circumferential face which includes a flat portion and a curved portion;

a first pivotable member, movable between a first position and a second position in accordance with the rotation of the sheet feeding roller, the first pivotable member comprising a first contact face and an extended member extended from a free end portion of the first pivotable member toward a downstream side of a sheet feeding direction, wherein in the first position, the first contact face is vertically oriented; and a second pivotable member, movable between a third position and a fourth position in accordance with the rotation of the sheet feeding roller, the second pivotable member comprising a second contact face, wherein in the third position, the second contact face is horizontally oriented, wherein:

the first pivotable member is moved to the second position when a sheet medium is placed between the sheet feeding roller and the first pivotable member and the first pivotable member comes in contact with the curved portion through the sheet medium; the first pivotable member is returned to the first position when a trailing end of the sheet medium faces the flat portion of the sheet feeding roller while the extended member of the first pivotable member comes in contact with the sheet medium, and when the first pivotable member is placed in the first position and the sheet medium is placed between the sheet feeding roller and the first pivotable member, the first contact face comes in contact with a leading end of the sheet medium.

9. The sheet feeding device as set forth in claim 8, wherein:

the second pivotable member is placed in the third position and the first pivotable member is placed in the first position when no sheet medium is placed between the sheet feeding roller and the first pivotable member, so that a gap is formed between the flat portion of the sheet feeding roller and the second contact face while the flat portion of the sheet feeding roller and the first contact face are extended substantially perpendicularly to each other;

the second pivotable member is moved to the fourth position and the first pivotable member is moved to the second position when the sheet medium is placed between the sheet feeding roller and the first pivotable member while the first contact face and the second contact face press the sheet medium against the curved portion of the sheet feeding roller.

10. The sheet feeding device as set forth in claim 8, wherein the first contact face and the extended member are extended substantially perpendicular to each other.

11. The sheet feeding device as set forth in claim 8, wherein the extended member has a curved contact face.

12. The sheet feeding device as set forth in claim 9, wherein a pressing force of the second pivotable member is less than a pressing force of the first pivotable member.

13. The sheet feeding device as set forth in claim 9, wherein the extended member is shaped and positioned such that the first pivotable member is returned to the first position as the trailing end of the sheet medium is fed downstream from the second pivotable member.

14. A sheet feeding device comprising:

a sheet feeding roller having an outer circumferential face which includes a flat portion and a curved portion;

a first pressing member disposed facing the sheet feeding roller and including a first contact face, the first pressing member being urged in the pressing direction toward the sheet feeding roller and being movable between a first position and a second position, wherein in the first position, the first contact face is vertically oriented; and a second pressing member disposed facing the sheet feeding roller upstream from the first pressing member and including a second contact face, the second pressing member being urged in a pressing direction toward the sheet feeding roller and being movable between a third position and a fourth position, wherein in the third position, the second contact face is horizontally oriented, wherein a sheet receiving area is defined between the first pressing member, the sheet feeding roller and the second pressing member; and wherein when the sheet feeding roller feeds the sheet from the sheet receiving area in a downstream direction, the sheet is pressed against the sheet feeding roller and the first and second pressing members are pushed by the sheet in a direction opposite from the pressing direction, wherein the first pressing member is structured such that as a trailing end of the sheet is fed downstream from the second pressing member, the first pressing member is returned in the pressing direction from the second position to the first position, and wherein when the sheet is placed in the sheet receiving area and the sheet feeding roller does not feed the sheet, the first pressing member comes in contact with a leading end of the sheet.

15. The sheet feeding device as set forth in claim 14, wherein prior to the sheet feeding roller feeding a sheet, the first pressing member and the second pressing member are disposed substantially perpendicular to each other such that when the first pressing member returns in the pressing direction, the first pressing member serves to align sheets in the sheet receiving area.

16. The sheet feeding device as set forth in claim 14, wherein the first pressing member comprises an extended member extended therefrom on a downstream side thereof, the extended member being shaped and positioned such that the first pressing member is returned in the pressing direction as the trailing end of the sheet is fed downstream from the second pressing member.

17. The sheet feeding device as set forth in claim 14, wherein a pressing force of the second pressing member is less than a pressing force of the first pressing member.

* * * * *